US007618111B2

(12) United States Patent
Lin

(10) Patent No.: US 7,618,111 B2
(45) Date of Patent: Nov. 17, 2009

(54) APPARATUS, METHOD AND INK JET PRINTER CAPABLE OF DETERMINING MATERIAL OF PRINTING MEDIA ACCORDING TO TRANSMISSION LIGHT PASSING THROUGH PRINTING MEDIA

(75) Inventor: Yung-Shan Lin, Ping-Tung Hsien (TW)

(73) Assignee: Lite-On Technology Corp., Taipei (TW)

( * ) Notice: Subject to any disclaimer, the term of this patent is extended or adjusted under 35 U.S.C. 154(b) by 494 days.

(21) Appl. No.: 11/381,751

(22) Filed: May 5, 2006

(65) Prior Publication Data

US 2007/0092328 A1 Apr. 26, 2007

(30) Foreign Application Priority Data

Oct. 21, 2005 (TW) ..... 94136855 A

(51) Int. Cl.
*B41J 29/38* (2006.01)

(52) U.S. Cl. ..... 347/14; 347/19

(58) Field of Classification Search ..... 347/14–16, 347/9, 12, 49, 19, 101–105
See application file for complete search history.

(56) References Cited

U.S. PATENT DOCUMENTS

| | | | | |
|---|---|---|---|---|
| 6,394,676 | B1 | 5/2002 | Dresher | |
| 6,795,191 | B2 * | 9/2004 | Barbehenn | 356/445 |
| 6,984,034 | B2 * | 1/2006 | Tsujimoto | 347/105 |
| 7,046,954 | B2 * | 5/2006 | Yokoi | 399/389 |
| 7,204,653 | B2 * | 4/2007 | Fujioka et al. | 400/578 |
| 2003/0015025 | A1 | 1/2003 | Lindig | |
| 2004/0129901 | A1 | 7/2004 | Yamaguchi | |

FOREIGN PATENT DOCUMENTS

| | | |
|---|---|---|
| JP | 10-39556 | 2/1998 |

* cited by examiner

*Primary Examiner*—Thinh H Nguyen
(74) *Attorney, Agent, or Firm*—Kile Goekjian Reed & McManus PLLC

(57) ABSTRACT

An apparatus for determining a material of a printing media, includes a light source for exposing the printing media to light; a photo detector for detecting the transmission light, the transmission light generated by the light source and passing through the printing media, to generate an intensity value; and an analysis unit, electrically connected to the photo detector, for analyzing the intensity value to determine the material of the printing media.

17 Claims, 8 Drawing Sheets

APPARATUS, METHOD AND INK JET PRINTER CAPABLE OF DETERMINING MATERIAL OF PRINTING MEDIA ACCORDING TO TRANSMISSION LIGHT PASSING THROUGH PRINTING MEDIA

BACKGROUND OF THE INVENTION

1. Field of the Invention

The present invention provides an apparatus and a method capable of determining a material of a printing media, and in particular, an apparatus and a method that detects transmission light from the printing media to form an image, and analyzes the transmission light intensity to determine the material of the printing media. Furthermore, the present invention also introduces an ink jet printer that applies the apparatus and the method.

2. Description of the Prior Art

In a general case, when a media is printed by a printer, a notable quality difference will exist between different materials. For example, photo paper will have a good performance but the pattern on normal paper will be blurred due to ink spread. Before printing, therefore, users have to manually set the material and type setting of printing media at such as photo paper, normal paper, slides etc. The printer adjusts the ink jet head to jet ink at a suitable speed and amount according to the material parameter setting in order to achieve optimal print performance. If the material and printing media type are not set by users prior to printing a bad print performance may occur. In such a case it is possible to reprint the material, however, this is inconvenient and inefficient, resulting in meaningless paper waste.

In the related art, a plurality of light sources and a light receiver (or a light source and a plurality of light receivers) are utilized to receive reflected light and transmission light from the printing media, and then the light vectors according to the reflected light and the transmission light are compared at a co-ordinate axis to analyze the material of the printing media. The other method locates a rotatable circular wheel including a fillister behind the printing media, and determines the material of the printing media through monitoring a pattern generated by the reflected light from the circular wheel. The methods discussed above require complex mechanical structures and devices in order to obtain a correct result, therefore manufacturing costs will be high.

SUMMARY OF THE INVENTION

It is therefore one objective of the present invention to provide an apparatus and a method for determining the material of the printing media. Furthermore, the present invention also introduces an ink jet printer for applying the apparatus and the method. The ink jet printer is capable of automatically determining the material of the printing media without manual settings, to solve the above-mentioned problems.

According to an embodiment of the present invention, an apparatus for determining the material of the printing media is disclosed. The apparatus includes a light source for generating light to expose the printing media; a photo detector for detecting transmission light from the printing media to generate a light intensity value of the transmission light corresponding to the printing media; and an analysis unit, electrically connected to the photo detector, for analyzing the light intensity value to determine the material of the printing media.

According to an embodiment of the present invention, a method for determining the material of the printing media is disclosed. The method includes: exposing the printing media; detecting transmission light from the printing media to generate a light intensity value of the transmission light corresponding to the printing media; and analyzing the light intensity value to determine the material of the printing media.

According to an embodiment of the present invention, an ink jet printer capable of determining the material of a printing media is disclosed. The ink jet printer includes a light source for generating light to expose the printing media; a photo detector for detecting transmission light from the printing media to generate a light intensity value of the transmission light corresponding to the printing media; an analysis unit, electrically connected to the photo detector, for analyzing the light intensity value to determine the material of the printing media; a printing control module, electrically connected to the analysis unit, for setting a printing parameter according to the material of the printing media; and at least one ink jet print head, electrically connected to the printing control module, for determining an ink-jetting model of the ink jet printer according to the printing parameter.

The apparatus for determining the material of the printing media is disclosed in the present invention. It applies a light source to expose the printing media, and then detects the transmission light from the printing media to generate a light intensity value. Due to the light intensity value including information of the printing media material, the material of the printing media can be substantially determined by analyzing the light intensity value. The ink jet printer disclosed in the present invention utilizes this mechanism to automatically determine the material of the printing media before the ink jet printer prints the media. As there is no need for a manual setting by users, the present invention improves both the convenience and the quality of printing. Furthermore, the manufacturing cost is greatly reduced.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
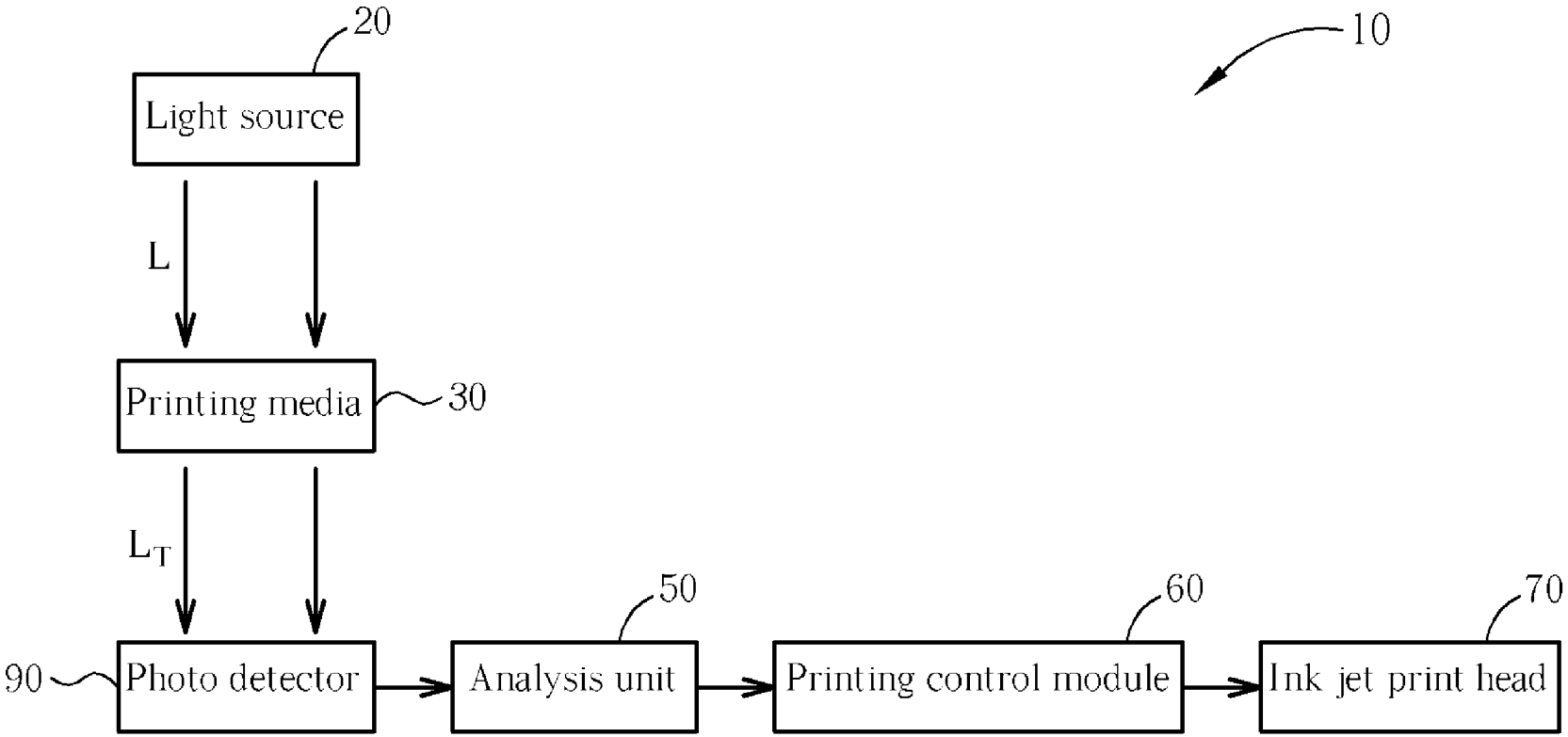
FIG. 1 is a block diagram of the ink jet printer according to an embodiment of the present invention.

Please refer to FIG. 1. FIG. 1 is a block diagram of the ink jet printer 10 according to an embodiment of the present invention. As shown in FIG. 1, the ink jet printer 10 includes a light source 20, a photo detector 90, an analysis unit 50, a printing control module 60, and an ink jet print head 70, wherein the light source 20, the photo detector 90, and the analysis unit 50 are combined to form a determinant apparatus disclosed in the present invention to determine the material of a printing media 30. The combination and operation principles are discussed herein. When the ink jet printer 10 starts to print, the light source 20 (such as a light emitting diode (LED)) provides light L to expose the printing media 30, with part of the light L passing through the printing media 30 becoming transmission light $L_T$. The photo detector 90 receives the transmission light $L_T$ and generates a light intensity value according to light intensity of the transmission light $L_T$, then transmits the light intensity value to the analysis unit 50. Next, the analysis unit 50 analyzes the light intensity value to determine the material of the printing media 30, and the printing control module 60 then sets a printing parameter according to the material of the printing media 30. Finally, the ink jet print head 70 determines a print model for the printing media 30 according to the printing parameter. For example, the print model includes setting values such as ink amount and jet speed. In the print procedure, the ink jet printer 10 automatically detects the material of the printing media 30 (such as photo paper, normal paper, slides etc.) and then sets the printing parameter according to the material of the printing media 30 in order to achieve the optimal print performance.

Figure 2:
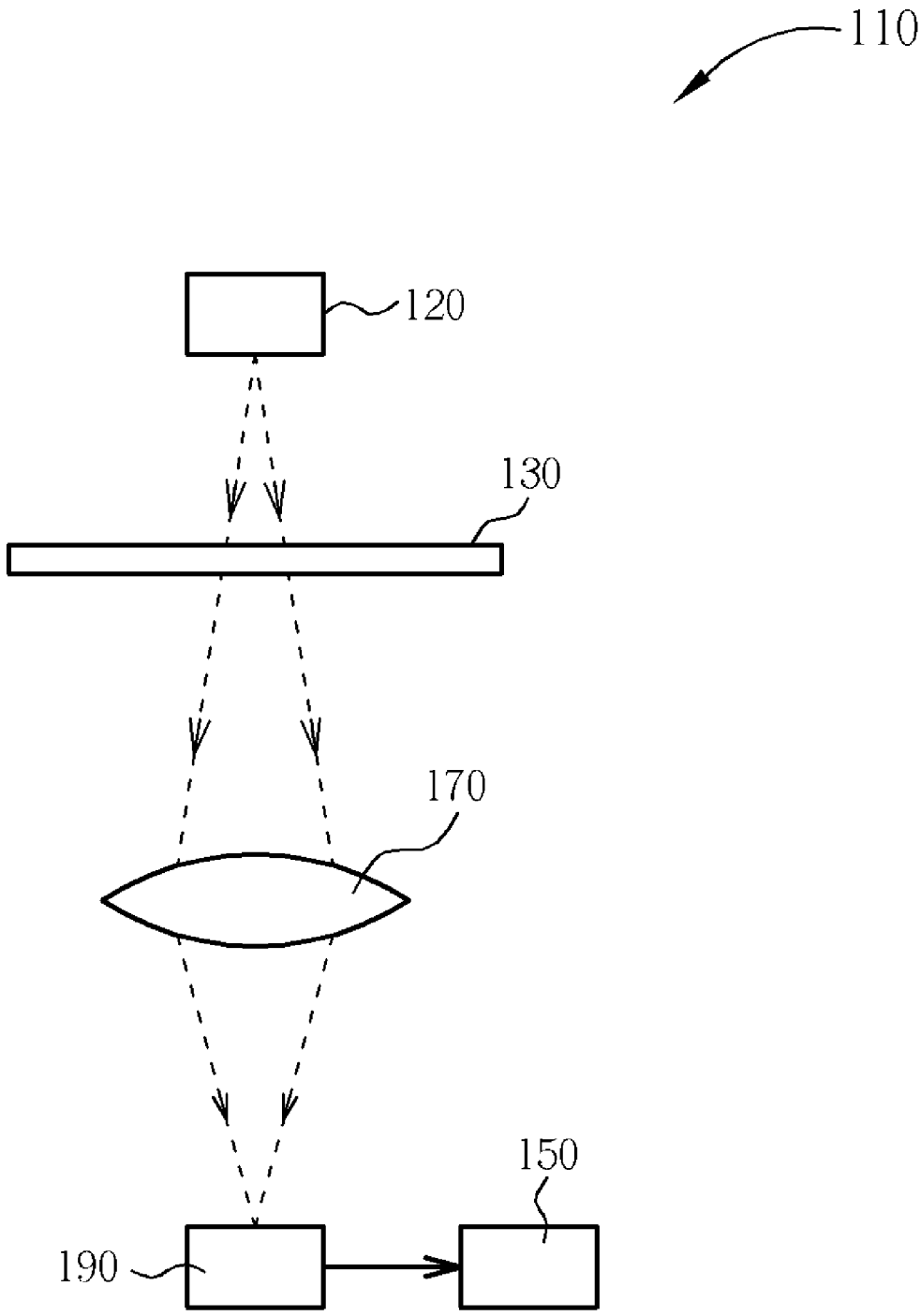
FIG. 2 is a diagram of the apparatus according to a first embodiment of the present invention.

In FIG. 1, the light source 20, the photo detector 90, and the analysis unit 50 are combined to form the determinant apparatus. Please note that this is only one example of the present invention, and the combination of the determinant apparatus is not limited to this example. Please refer to FIG. 2. FIG. 2 is a diagram of the determinant apparatus according to a first embodiment of the present invention. As illustrated in FIG. 2, the apparatus 110 includes a light source 120 for providing light to expose the printing media 130; a photo detector 190 for detecting the transmission light passed through the printing media 130 in order to obtain a light intensity value corresponding to light intensity of the transmission light; a lens 170 for collecting the transmission light to focus on the photo detector 190; and an analysis unit 150 for analyzing the light intensity value to determine the material of the printing media 130. In the beginning, the light source 120 provides light to expose the printing media 130 to generate transmission light. Obviously, transmission light intensity is related to the material of the printing media 130. For example, photo paper is smooth, so the transmission light intensity is weak; but slides are transparent objects, so the transmission light intensity is strong.

Figure 3:
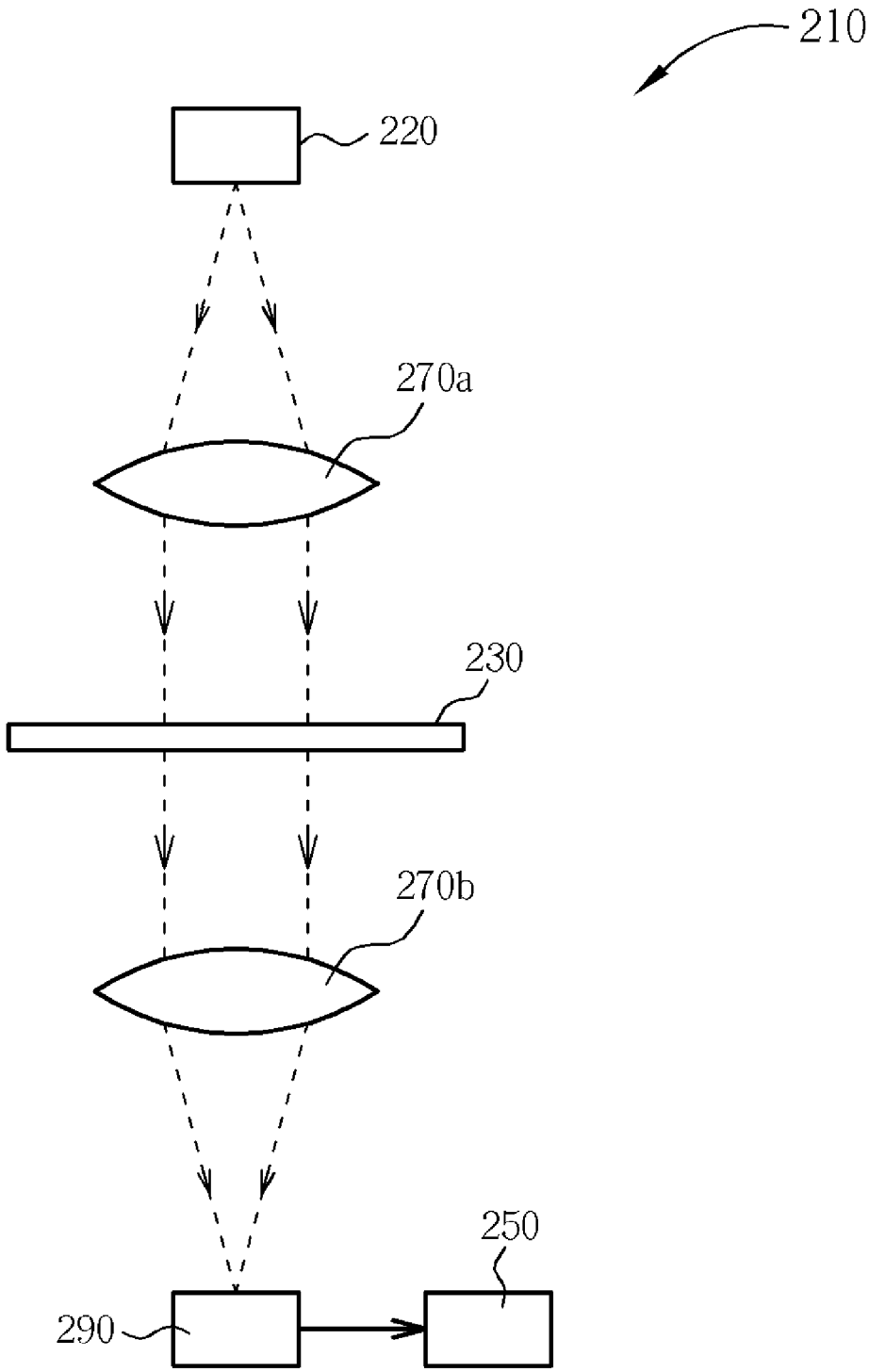
FIG. 3 is a diagram of the apparatus according to a second embodiment of the present invention.

As mentioned above, the transmission light intensity is related to the information about the material of the printing media 130. In order to accurately analyze the transmission light, a lens 170 is positioned at the route of the transmission light to focus the transmission light on the photo detector 190. Next, the photo detector 190 transforms the transmission light intensity into the light intensity value, and the analysis unit 150 then analyzes the light intensity value corresponding to the transmission light from the printing media 130 to determine the material of the printing media 130. For example, the analysis unit 150 transforms the transmission light intensity into voltages or currents and then compares these electric signals with a threshold value set (such as voltages or currents) to determine the material of the printing media 130. According to the magnitude relationship between the light intensity value and elements in the threshold value set, the material of the printing media 130 can be substantially determined. For example, if the light intensity value is located between two greater voltages, it can be determined that the light intensity of the transmission light is strong. That is, if the material of the printing media 130 is not strongly reflective; the printing media 130 is likely to be a transparent media such as a slide, or rough paper such as reprocessed (recycled) paper. On the other hand, if the light intensity value is located between two lesser voltages, it can be determined that the light intensity of the transmission light is weak. Therefore the printing media 130 is likely to be a reflecting paper such as photo paper. In order to accurately analyze the transmission light, the apparatus 110 includes a lens 170 in this embodiment. Please note that the lens 170 is not a necessary device and is positioned in the apparatus 110 according to design requirements. It is possible to increase numbers of the lens 170 in the apparatus 110 to improve accuracy. Please refer to FIG. 3. FIG. 3 is a diagram of the determinant apparatus according to a second embodiment of the present invention. In this embodiment, the apparatus 210 includes a light source 220, two lenses 270*a* and 270*b*, a photo detector 290, and an analysis unit 250. The elements of the second embodiment are almost the same as the elements of the first embodiment. The only difference is that there is a lens 270*a* positioned between the printing media 230 and the light source 220 in the second embodiment. The lens 270*a* focuses light provided by the light source 220 on the analyzed region of the printing media 230, so that the apparatus 210 is capable of determining the material of the printing media 230 accurately.

Figure 4:
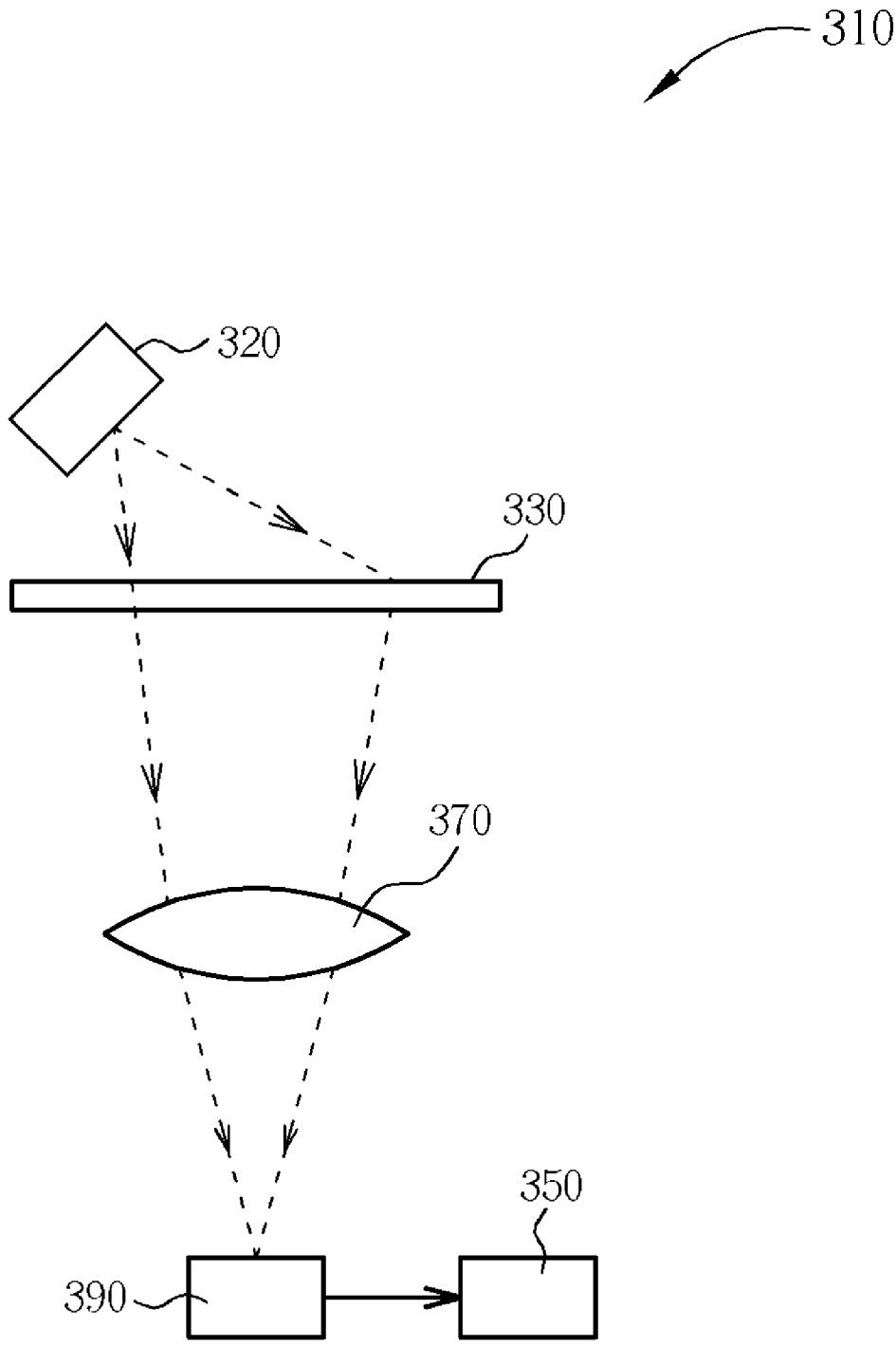
FIG. 4 is a diagram of the apparatus according to a third embodiment of the present invention.
Figure 5:
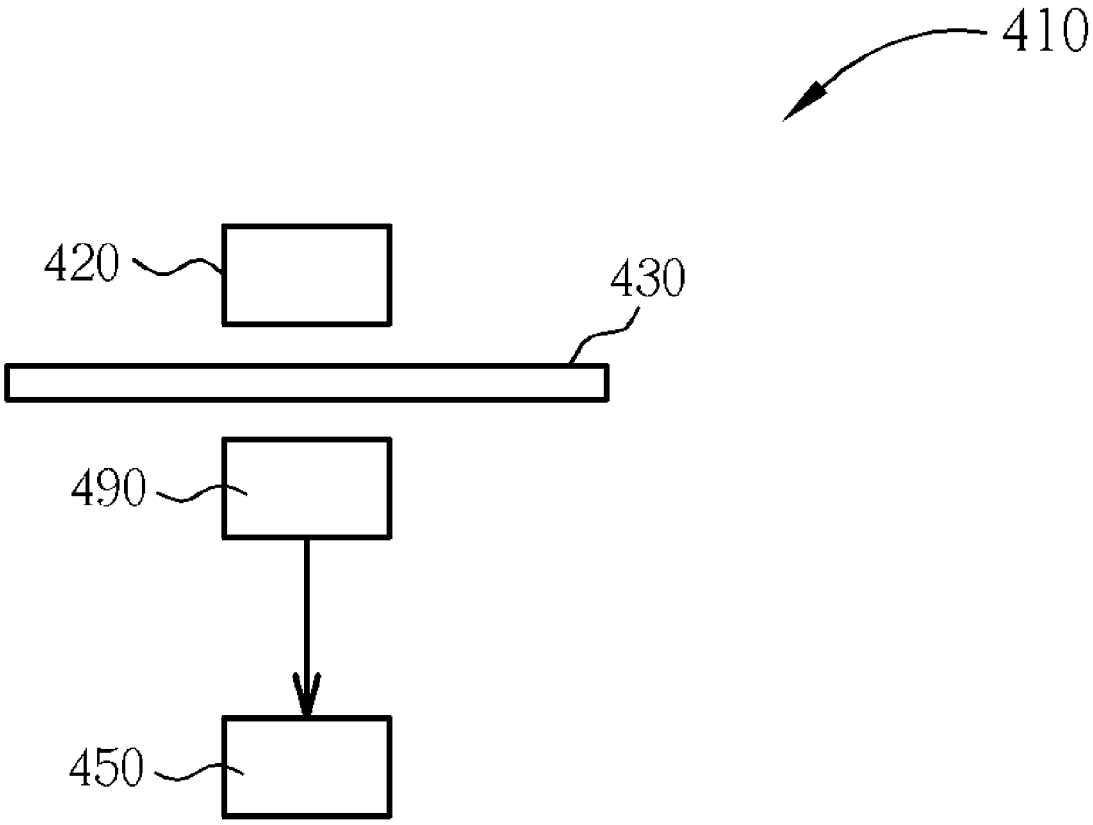
FIG. 5 is a diagram of the apparatus according to a fourth embodiment of the present invention.

Please note that the photo detector in the embodiments of this invention can be realized by any kind of optical sensor, such as a photodiode. In this embodiment, numbers of the photo detector are decided according to the design requirements, and are not limited to one. Moreover, the photodiode directly transforms the transmission light into an electrical signal and the analysis unit 250 just has to deal the electrical signal with the threshold value set to determine the material of the printing media. Please refer to FIG. 4. FIG. 4 is a diagram of the determinant apparatus according to a third embodiment of the present invention. As shown in FIG. 4, the apparatus 310 includes a light source 320, a lens 370, a photo detector 390, and an analysis unit 350. Elements of the third embodiment are almost the same as elements of the first embodiment; the only difference is that the light source 320, the printing media 330, and the photo detector 390 are not arranged in a straight line. Consequently, the photo detector 390 not only detects the light intensity of the transmission light, but also has an increased flexibility of design. This method determines whether the reflected light is dissipated seriously. For accuracy in determination, the printing surface of the printing media 330 is face on to the light source 320 such that the light intensity of the transmission light represents the material of the printing media exactly. Please refer to FIG. 5. FIG. 5 is a diagram of the apparatus 410 according to a fourth embodiment of the present invention. The apparatus 410 shown in FIG. 5 includes a light source 420, a photo detector 490, and an analysis unit 450. For decreasing cost and size, the lens 170 in the first embodiment and the lenses 270*a* and 270*b* in the second embodiment can be neglected. In this circumstance, as shown in FIG. 5, both the light source 420 and the photo detector 490 have to be very close to the printing media 430 to avoid significant light dissipation confusing the determining result. As the operation principles in the first, second, third, and fourth embodiments are the same, the description below takes the first embodiment as an example.

Figure 6:
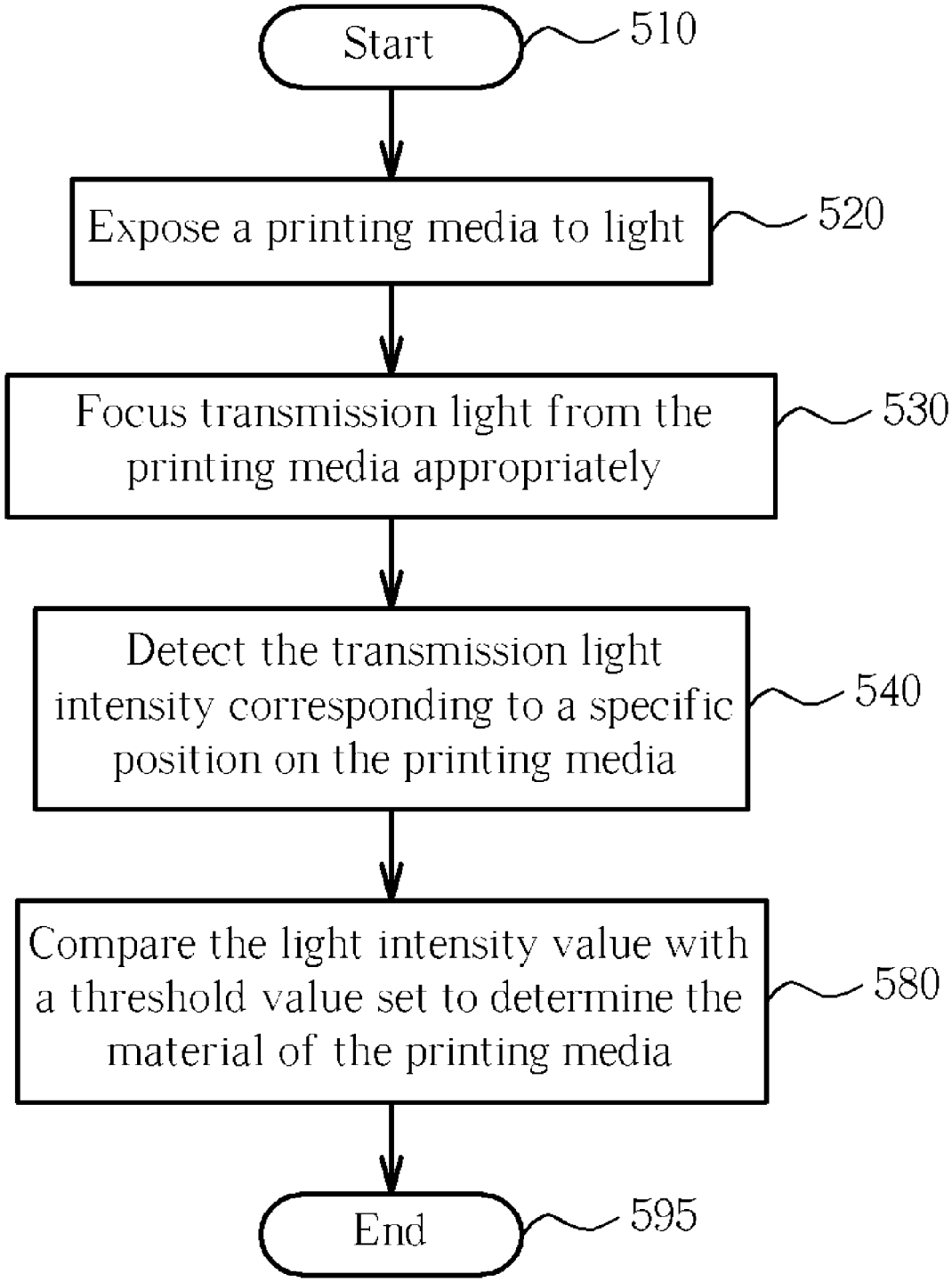
FIG. 6 is a flowchart of the method for determining the material of the printing media shown in FIG. 2 according to the first embodiment of the present invention.

Please refer to FIG. 2 and FIG. 6. FIG. 6 is a flowchart of the method for determining the material of the printing media 130 shown in FIG. 2 according to the first embodiment of the present invention. The steps of determining the material of the printing media 130 are listed below.

Step 510: start;

Step 520: utilize a light source 120 to expose a printing media 130;

Step 530: utilize a lens 170 to appropriately focus the transmission light on the photo detector 190;

Step 540: utilize a photo detector 190 to detect the transmission light intensity corresponding to a specific position on the printing media 130 to obtain a light intensity value;

Step 580: utilize the analysis unit 150 to compare the light intensity value with a threshold value set to determine the material of the printing media 130;

Step 595: end.

Figure 7:
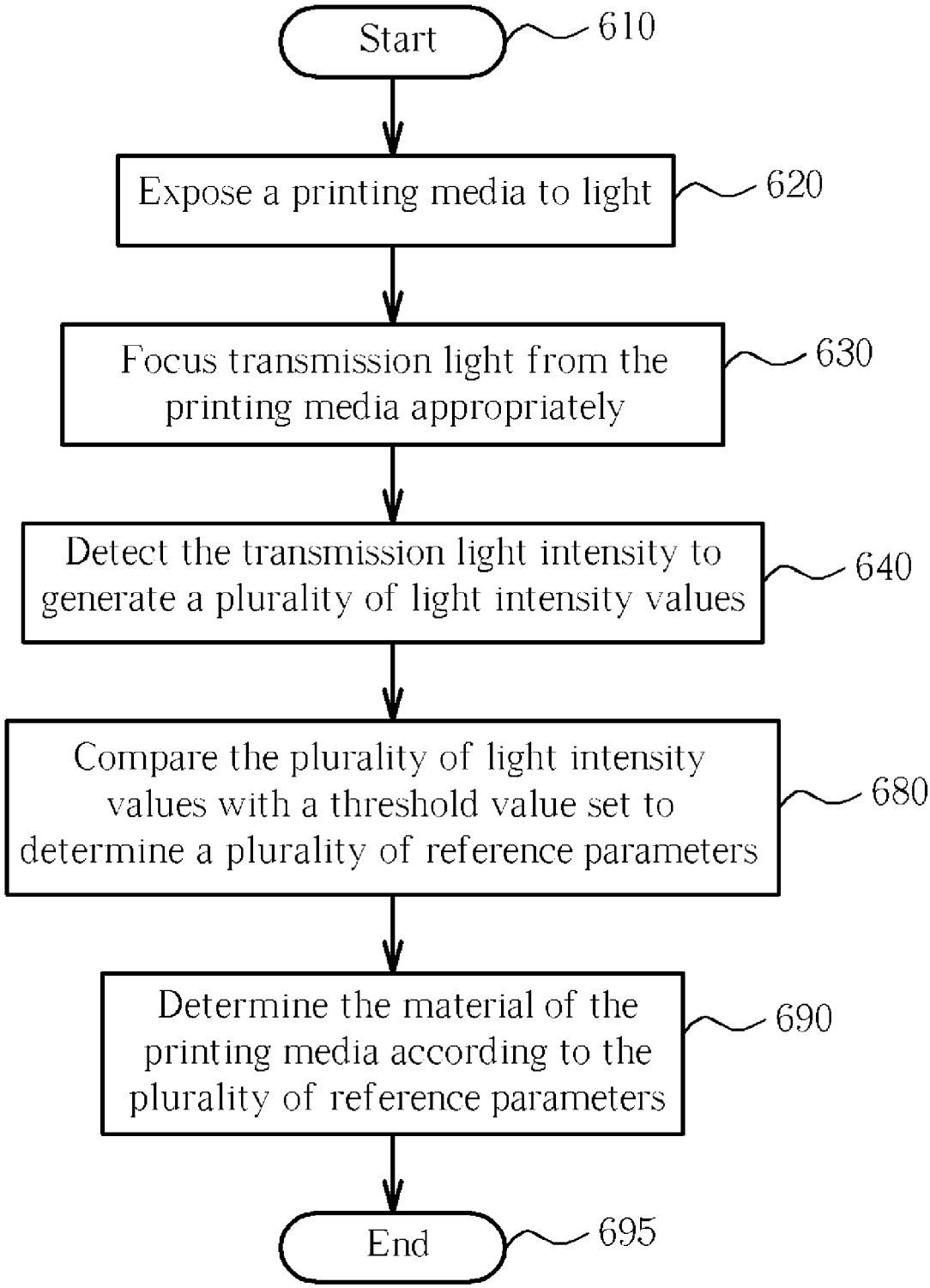
FIG. 7 is a flowchart of the method for determining the material of the printing media shown in FIG. 2 according to the second embodiment of the present invention.

The above determinant mechanism is one embodiment of the present invention; however, there are other mechanisms to determine the material of the printing media 130. For example, the photo detector 190 can gather transmission light corresponding to different positions of the printing media 130 to generate a plurality of light intensity values. The analysis unit 150 separately compares the plurality of light intensity values with a threshold value set (such as voltage values or current values) to determine a plurality of reference parameters. Next, the analysis unit 150 determines the material of the printing media 130 according to the plurality of reference parameters. Please refer to FIG. 2 and FIG. 7. FIG. 7 is a flowchart of the method for determining the material of the printing media 130 shown in FIG. 2 according to the second embodiment of the present invention. The steps of determining the material of the printing media 130 are listed below.

Step 610: start;

Step 620: utilize a light source 120 to expose a printing media 130;

Step 630: utilize a lens 170 to appropriately focus the transmission light on the photo detector 190;

Step 640: utilize a photo detector 190 to detect the transmission light intensity to generate a plurality of light intensity values;

Step 680: utilize the analysis unit 150 to separately compare every light intensity value with a threshold value set (such as voltage values or current values) to determine a plurality of reference parameters;

Step 690: utilize the analysis unit 150 to determine the material of the printing media 130 according to the plurality of reference parameters and the threshold value set;

Step 695: end.

For example, assume the photo detector 190 detects ten light intensity values corresponding to different positions of the same printing media 130. Next, the analysis unit 150 transforms these ten light intensity values into voltages and then compares the voltages with a voltage value set. If there are seven light intensity values between the first and second voltage values, the analysis unit 150 generates a first reference parameter (for example, averaging the seven light intensity values to compare with a voltage value set to generate the first reference parameter), therefore the first reference parameter will also be between the first and second voltage values; if there are two light intensity values between the second and third voltage values, the analysis unit 150 generates a second reference parameter, so the second reference parameter will be between the second and third voltage values; and if the last light intensity value lies in between the third and fourth voltage values, the analysis unit 150 generates a third reference parameter, so the third reference parameter will be between the third and fourth voltage values. Through analyzing the distribution relationship of these ten light intensity values in the voltage value set, it is obvious that most light intensity values will be located between the first and second voltage values. Therefore the first reference parameter located between the first and second voltage values can be the representation of the material of the printing media 130. If the first and second voltage values represent that the light intensity is strong, this means the transparency of the printing media 130 is good, and the printing media 130 can be determined to be made by a rough material such as reprocessed paper or a transparent material such as a slide. On the other hand, if the first and second voltage values represent that the light intensity is weak, this means the transparency of the printing media 130 is bad, and the printing media 130 can be determined to be made by a smooth material such as photo paper.

Figure 8:
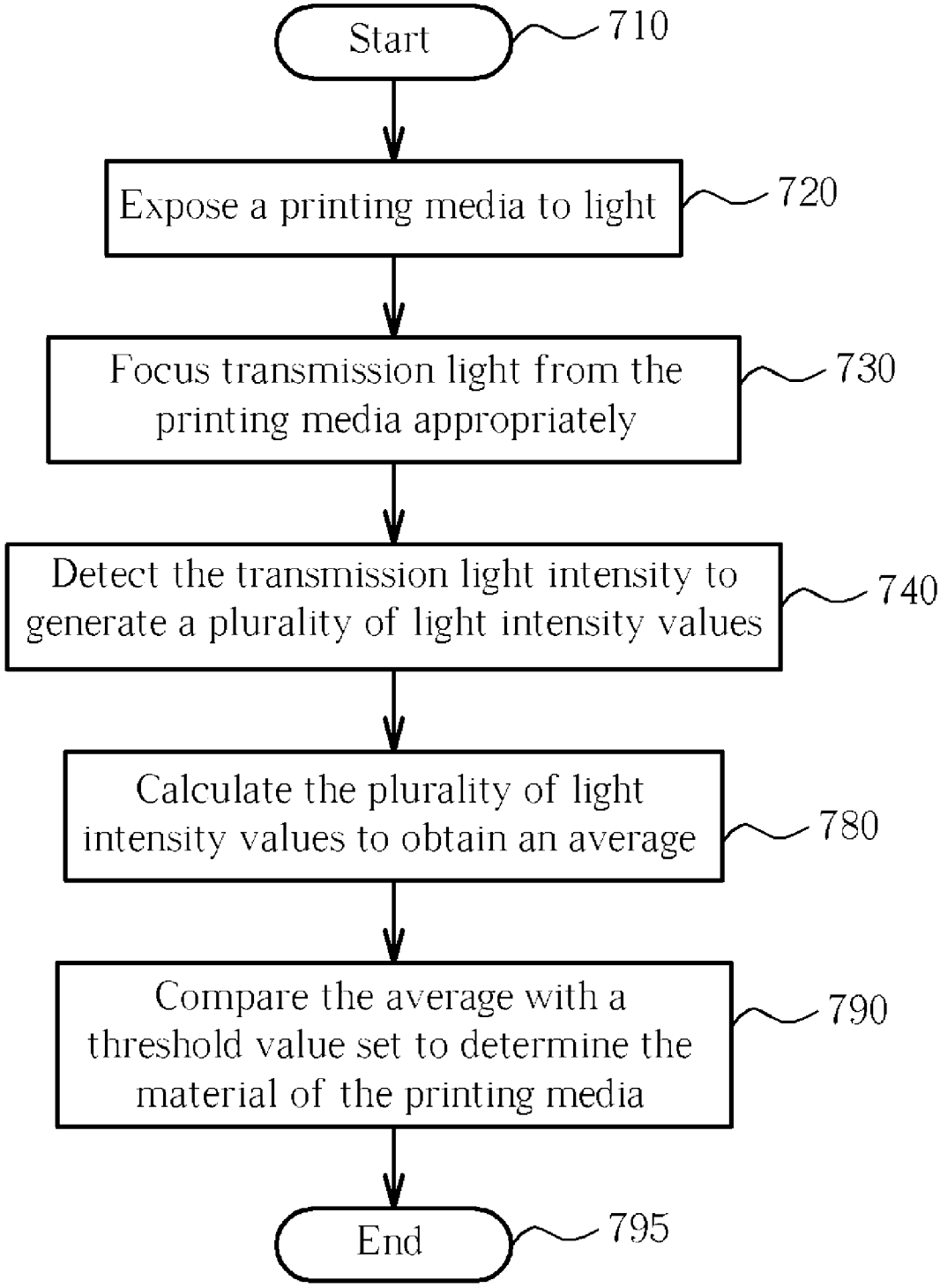
FIG. 8 is a flowchart of the method for determining the material of the printing media shown in FIG. 2 according to the third embodiment of the present invention.

Another method for determining the material of the printing media 130 according to a plurality of light intensity values of the transmission light is: obtaining an average of the plurality of light intensity values and then comparing the average with a threshold value set (such as voltage values and current values) to determine the material of the printing media 130. Please refer to FIG. 2 and FIG. 8. FIG. 8 is a flowchart of the method for determining the material of the printing media 130 shown in FIG. 2 according to the third embodiment of the present invention. The steps are explicitly discussed in the following.

Step 710: start;

Step 720: utilize a light source 120 to expose a printing media 130;

Step 730: utilize a lens 170 to appropriately focus the transmission light on the photo detector 190;

Step 740: utilize a photo detector 190 to detect the transmission light intensity to generate a plurality of light intensity values;

Step 780: utilize the analysis unit 150 to calculate the plurality of light intensity values to obtain an average;

Step 790: utilize the analysis unit 150 to compare the average with a threshold value set (such as voltage values and current values) to determine the material of the printing media 130;

Step 795: end.

As the average value represents substantial characteristics of the printing media 130, the average value can be utilized to determine the material of the printing media 130. For example, the photo detector 190 detects ten light intensity values corresponding to different positions of the same printing media 130. Next, the analysis unit 150 calculates ten light intensity values to obtain an average. Again, if the average is located between two greater voltage values in the threshold value set, then the printing media 130 can be determined to be made by a rough material such as reprocessed paper or a transparent material such as a slide; however, if the average is located between two lesser voltage values in the threshold value set, then the printing media 130 can be determined to be made by a smooth material such as photo paper.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An apparatus for determining the material of a printing media, the apparatus comprising:

a light source for generating light to expose the printing media;

a photo detector for detecting transmission light from the light source through the printing media to generate a plurality of light intensity values corresponding to different positions of the printing media; and an analysis unit, electrically connected to the photo detector, for separately comparing the plurality of light intensity values with a threshold value set to determine a plurality of reference parameters, and then determining the material of the printing media according to the plurality of reference parameters.

2. The apparatus of claim 1, wherein the light source is a light emitting diode (LED).

3. The apparatus of claim 1, wherein the analysis unit compares the light intensity value with a threshold value set to determine the material of the printing media.

4. The apparatus of claim 1, wherein the analysis unit calculates the plurality of light intensity values to obtain an average, and then compares the average with a threshold value set to determine the material of the printing media.

5. The apparatus of claim 1, wherein the photo detector is a photodiode.

6. The apparatus of claim 1, further comprising a lens for gathering the transmission light to focus on the photo detector.

7. A method for determining the material of a printing media, the method comprising:

exposing the printing media;

detecting transmission light from the printing media to generate a plurality of light intensity values corresponding to different positions of the printing media; and separately comparing the plurality of light intensity values with a threshold value set to determine a plurality of reference parameters and then determining the material of the printing media according to the plurality of reference parameters.

8. The method of claim 7, wherein the step of analyzing the light intensity value to determine the material of the printing media farther comprises:

comparing the light intensity value with a threshold value set to determine the material of the printing media.

9. The method of claim 7, wherein the step of analyzing the plurality of light intensity values to determine the material of the printing media further comprises:

calculating the plurality of light intensity values to obtain an average and then comparing the average with a threshold value set to determine the material of the printing media.

10. The method of claim 7, further comprising:

gathering the transmission light from the printing media, and then appropriately focusing the transmission light to obtain an accurate light intensity value.

11. The method of claim 7, further comprising:

utilizing a photodiode to transform the transmission light into an electrical signal; and determining the material of the printing media according to a value of the electrical signal.

12. An ink jet printer capable of determining the material of a printing media, the ink jet printer comprising:

a light source for generating light to expose the printing media;

a photo detector for detecting transmission light from the light source through the printing media to generate a plurality of light intensity values corresponding to different positions of the printing media;

an analysis unit, electrically connected to the photo detector, for separately comparing the plurality of light intensity values with a threshold value set to determine a plurality of reference parameters, and then determining the material of the printing media according to the plurality of reference parameters;

a printing control module, electrically connected to the analysis unit, for setting a printing parameter according to the material of the printing media; and at least one ink jet print head, electrically connected to the printing control module, for determining an ink-jetting model of the ink jet printer according to the printing parameter.

13. The ink jet printer of claim 12, wherein the light source is a light emitting diode (LED).

14. The ink jet printer of claim 12, wherein the analysis unit compares the light intensity value with a threshold value set to determine the material of the printing media.

15. The ink jet printer of claim 12, wherein the analysis unit calculates the plurality of light intensity values to obtain an average, and then compares the average with a threshold value set to determine the material of the printing media.

16. The ink jet printer of claim 12, wherein the photo detector is a photodiode.

17. The ink jet printer of claim 12, further comprising a lens for gathering the transmission light to focus on the photo detector.

* * * * *